US006551194B2

(12) United States Patent
Hammerquist

(10) Patent No.: US 6,551,194 B2
(45) Date of Patent: Apr. 22, 2003

(54) CAPTIVE BALL GOLF PRACTICE TEE WITH THREE-DIMENSION VELOCITY AND TWO-AXIS SPIN MEASUREMENT

(76) Inventor: Earl Leon Hammerquist, 6969 Hastings St., Moorpark, CA (US) 93021

( * ) Notice: Subject to any disclaimer, the term of this patent is extended or adjusted under 35 U.S.C. 154(b) by 24 days.

(21) Appl. No.: 09/801,328

(22) Filed: Mar. 6, 2001

(65) Prior Publication Data

US 2001/0009870 A1 Jul. 26, 2001

Related U.S. Application Data

(63) Continuation-in-part of application No. 09/343,098, filed on Jun. 29, 1999, now abandoned.

(51) Int. Cl.[7] ..... A63B 57/00; A63B 53/00

(52) U.S. Cl. ..... 473/145; 73/65.03

(58) Field of Search ..... 473/184, 131, 473/139–140, 143, 145–148, 151, 188–189, 192, 199–200, 222, 225, 353, 373–378; 434/252; 342/107, 113, 118, 104; 73/65.03, 379.04, 488, 503.3, 504.07, 504.12, 504.13, 504.14, 510–512, 720, 514.16, 514.31

(56) References Cited

U.S. PATENT DOCUMENTS

| | | | | |
|---|---|---|---|---|
| 1,680,897 A | | 8/1928 | Matteson | |
| 1,857,588 A | | 5/1932 | Doll | |
| 3,020,049 A | | 2/1962 | McNeill | |
| 3,282,109 A | | 11/1966 | Kamiya | |
| 3,324,726 A | | 6/1967 | Turczynski | |
| 3,647,219 A | * | 3/1972 | Ravatt | 473/145 |
| 3,743,296 A | | 7/1973 | Branz | |
| 3,815,922 A | | 6/1974 | Brainard | |
| 4,071,250 A | | 1/1978 | Vroome | |
| 4,848,769 A | | 7/1989 | Bell et al. | |
| 4,861,035 A | | 8/1989 | Page | |
| 4,940,236 A | | 7/1990 | Allen | |
| 5,056,790 A | | 10/1991 | Russell | |
| 5,255,920 A | | 10/1993 | Mangeri | |
| 5,401,026 A | | 3/1995 | Eccher et al. | |
| 5,437,457 A | * | 8/1995 | Curchod | 473/199 |
| 5,586,940 A | * | 12/1996 | Dosch et al. | 473/140 |
| 5,779,562 A | * | 7/1998 | Melvin et al. | 473/373 |
| 5,997,405 A | | 12/1999 | Russell et al. | |

OTHER PUBLICATIONS

Golf Digest, Feb. 1999, pp. 76–79, "Max Out Your Ball", Zander and Chou.

PC Systems Handbook, 1999–2000, pp. 60A, 60B, "Instrunet Remote 14–Bit Data Acquisition System".

Max's Home Page (http://www.telusplanet.net/public/maxs/), "Golf Ball Trajectory Model", Max Dupilka.

* cited by examiner

*Primary Examiner*—Kim Nguyen

(57) ABSTRACT

Golf practice apparatus, comprising two sphere segments of a simulated golf ball mounted on opposing sides of a pivotal structure, strain gauges mounted on the structure to measure strains caused by a strike force to the simulated ball, an electronics unit for digitally encoding voltages resulting from the strains, and software for determining a three-dimension strike force, torque content thereof, and strike force duration. Strain gauges mounted on the structure between the ball segments determine one component of the strike force and torque about both horizontal and vertical axes. Strain gauges mounted on a support column of the pivotal structure determine the remaining strike force components. Additional software is disclosed for deriving an initial three-dimension velocity vector and spin rates about both horizontal and vertical axes of a free ball similarly struck whereby a three-dimension trajectory of a free golf ball may be computed.

8 Claims, 5 Drawing Sheets

| | **Drawing call-outs** |
|---|---|
| 1 | Simulated ball |
| 11 | Ball segment |
| 12 | Shell segment |
| 16 | Computer (PC) |
| 17 | Assembly axis |
| 2 | Support structure |
| 21 | Column |
| 22 | Strain plate |
| 23 | Wedging plug |
| 24 | Retaining collar |
| 25 | Axle extensions (2) |
| 26 | Threaded rim of plug |
| 27 | Collar threading |
| 28 | Hub of wedging plug |
| 29 | Spokes of plug (4) |
| 30 | Radial areas of plate (4) |
| 31 | Machine screws (8) |
| 32 | Unthreaded collar part |
| 33 | Slots to retain shell (4) |
| 34 | Void of shell segment |
| 35 | Flat of ball segment |
| 36 | Radial slots on plate (8) |
| 41 | - X-axis strain gauge |
| 42 | + X-axis strain gauge |
| 43 | - Z-axis strain gauge |
| 44 | + Z-axis strain gauge |
| 45 | LH col. strain gauge |
| 46 | RH col. strain gauge |
| 5 | Mounting base |
| 51 | Teeing surface |
| 52 | Base plate |
| 53 | Axle journals |
| 54 | Cable assembly |
| 55 | Arresting cushion |
| 56 | Lever assembly |
| 57 | Rigid foam base |
| 58 | Rubber teeing mat |
| 59 | Multi-pin connector |
| 6 | Electronics Unit |
| 61 | Input channel (6) |
| 62 | Multiplexer (MUX) |
| 63 | Analog/Digital (A/D) |
| 64 | Controller |
| 65 | Power supply |
| 66 | Timing generator |
| 67 | MUX control |
| 68 | Threshold logic |
| 69 | A/D calibration logic |
| 70 | PC memory |
| 71 | Mean value function |
| 72 | Delta time function |
| 73 | Voltage to force function |
| 74 | Z-axis torque calc. ($\omega_{MZ}$) |
| 75 | X force calculation ($F_X$) |
| 76 | Y force calculation ($F_Y$) |
| 77 | Z force calculation ($F_{ZM}$) |
| 78 | X-axis torque calc.($\omega_{MX}$) |
| 79 | Centripetal force calc. ($F_C$) |
| 80 | $F_{MZ}$ correction to ($F_Z$) |
| 81 | XY plane force calc. ($F_{XY}$) |
| 82 | YZ plane force calc. ($F_{ZY}$) |
| 83 | YZ plane el. angle calc. ($\Psi$) |
| 84 | XY plane azimuth calc. ($\theta$) |
| 85 | F-vector mag. calc. ($F_V$) |
| 86 | F-vector elevation calc. ($\Phi$) |
| 87 | Torque correction ($\omega_{ZY}$) |
| 88 | Torque correction ($\omega_{XY}$) |
| 89 | Torque correction ($\omega_Z$) |
| 90 | Torque correction ($\omega_X$) |
| 91 | Z-axis app. torque table |
| 92 | X-axis app. torque table |
| 93 | V-vector mag. calc ($V_V$) |
| 94 | Z-axis spin rate calc. ($\omega_Z$) |
| 95 | X-axis spin rate calc. ($\omega_x$) |
| 96 | Tangential force calc. ($F_T$) |
| 97 | Force compare function |
| 110 | Detector – electronics unit |
| 111 | Filter – electronics unit |
| 112 | Amplifier – electronics unit |

| | **Coordinate System** |
|---|---|
| $\theta$ | Azimuth (in XY plane) |
| $\Phi$ | Elevation (from XY plane) |
| $\Psi$ | Elevation (from YZ plane) |
| X | X-axis |
| Y | Y-axis |
| Z | Z-axis |
| | **Strain Gauge Voltages** |
| $E_L$ | Left column - strike |
| $E_{LC}$ | Left column-centripetal |
| $E_R$ | Right column - strike |
| $E_{RC}$ | Right column-centripetal |
| $E_{-X}$ | –X axis - strike |
| $E_{+X}$ | +X axis - strike |
| $E_{-Z}$ | –Z axis - strike |
| $E_{+Z}$ | +Z axis - strike |
| | **Forces and Torques** |
| $F_C$ | Centripetal force |
| $F_X$ | Force, X directed |
| $F_Y$ | Force, Y directed |
| $F_Z$ | Force, Z directed |
| $F_V$ | Force vector magnitude |
| $\omega_X$ | Torque about X axis |
| $\omega_Z$ | Torque about Z axis |
| | **Spin Rates + Velocities** |
| $\omega_X$ | Spin rate about X axis |
| $\omega_Z$ | Spin rate about Z axis |
| $V_X$ | Velocity, X direct ed |
| $V_Y$ | Velocity, Y directed |
| $V_Z$ | Velocity, Z directed |
| $V_V$ | Velocity vector mag. |
| | **Calibration/Correction** |
| S | Voltage-to-force factor |
| P | Torque correction value |
| Q | $F_{ZM}$ correction factor |
| | **Masses/Inertia/Time** |
| $I_B$ | Inertia of free ball |
| $M_B$ | Mass of free ball |
| $M_A$ | Equivalent mass – assy. |
| $\Delta T$ | Strike duration |

Fig. 5

CAPTIVE BALL GOLF PRACTICE TEE WITH THREE-DIMENSION VELOCITY AND TWO-AXIS SPIN MEASUREMENT

CROSS-REFERENCE TO RELATED APPLICATIONS

This is a Continuation-In-Part (CIP) of Ser. No. 09/343,098, filed Jun. 29, 1999, now abandoned.

FEDERAL SPONSORSHIP

Not Applicable

MICROFICHE

Not Applicable

BACKGROUND OF THE INVENTION

This invention relates generally to gaming apparatus and more specifically to golf practice apparatus wherein a simulated ball attached to a pivotal support structure is struck.

Golf requires an inordinate amount of practice to become and remain proficient. Outdoor ranges are climate dependent and inconvenient for many, indoor ranges are space limited, and captive ball apparatus currently available does not provide the serious golfer with sufficiently accurate ball trajectory feedback. When striking a captive ball apparatus, the serious golfer wants to know the landing range, trajectory height, and lateral offset of a free ball similarly struck to within about 5 meters/yards (m/yd). Achieving that accuracy requires a three-dimension (3D) initial velocity vector accurate to about 3 mps (10 fps) in magnitude, about 0.5 degrees in azimuth and elevation, and a spin rate around both vertical and horizontal axes to about 100 rpm. Spin about a ball's vertical axis causes horizontal lift and increased drag resulting in a laterally curved flight path and reduced range. Spin about a horizontal axis causes vertical lift, increases drag, and may increase or decrease trajectory height and range. According to U.S. Golf Association (USGA) data as reported in the February, 1999 Golf Digest, pgs 76–79, "Maxing Out Your Ball", achieving an optimum horizontal axis spin rate of about 2200 rpm versus 3600 rpm typical of most golfers will add 20 to 30 yards (10 to 15 percent) for a ball well struck. Examples of the prior art having germane attributes, as underlined below, to this patent are found in U.S. Pat. Nos. 1,680,897; 3,743,296; 3.815.922; 4,940,236; 5,255,920; and 5,586,940.

U.S. Pat. No. 1,680,897 to Matteson in 1928 discloses a simulated ball mounted on an axle stem within a pivotal structure. Generators driven by the two axles produce current. Current from the pivotal axle is related to ball velocity and generally indicates distance. Current from the stem axle is related to spin rate about a vertical axis and generally indicates a laterally curved ball flight. Azimuth angle, elevation angle, and spin about the horizontal axis are not measured.

U.S. Pat. No. 3,743,296 to Branz in 1973 discloses a simulated ball mounted on an axle stem within a pivotal structure attached to a pivotal yoke. Light cells measure pivotal structure rotation rate (tangential velocity) and generally indicates distance. Cams on the stem axle activate switches to determine spin rate about a vertical axis to generally indicate a hook or slice. Yoke rotation permits the simulated ball to strike one of an array of switches to indicate azimuth. Elevation angle and spin about the horizontal axis are not measured.

U.S. Pat. No. 3,815,922 to Brainard in 1974 discloses a golf ball tethered to a vertical post to which a strain gauge is mounted and about which the ball and tether rotate. The strain gauge measures centripetal force that is related to tangential velocity. Free ball distance is computed from the tangential velocity and some predetermined launch angle. Azimuth angle, elevation angle, and spin are not measured.

U.S. Pat. No. 4,940,236 to Allen in 1990 discloses a transducer (strain gauge) attached to the face of a golf club. The transducer measures the strike force magnitude in a direction generally perpendicular to the face of the club and the duration of the strike event. Means are provided to determine a distance a golf ball would travel when similarly struck by an unaltered golf club at some predetermined launch angle. Azimuth angle, elevation angle, and spin are not measured.

U.S. Pat. No. 5,255,920 to Mangeri in 1993 discloses a golf ball appended to a semi-rigid tether attached to a horizontal axle. A strain gauge equipped flexible disk, in close proximity to the tether, and a slotted disk turn with the axle. When struck, the tether turns the axle and distorts the flexible disk. Light modulated by a slotted disk determines tangential velocity and disk distortion determines azimuth. Distance is computed for a predetermined elevation angle. Elevation angle and spin are not measured.

U.S. Pat. No. 5,586,940 to Dosch, et. al. in 1996 discloses orthogonal load cells (strain gauges) to measure arresting forces of a tethered ball when struck. Means are provided to time integrate 3D arresting forces and determine momentum from which a 3D velocity vector of a free ball so struck is derived. Light sensors are disclosed to determine the face angle of the striking club with means to derive spin rate about a vertical axis of a free ball. These data are used to compute a trajectory of a free ball similarly struck. Spin about the horizontal axis is not measured.

All prior art captive ball golf practice apparatus lack spin rate measurement about a horizontal axis and therefore can have errors exceeding 20 to 30 m/yd, far in excess of 5 m/yd needed by serious golfers. In general, the prior art focuses on measuring preliminary events such as club approach angle, on subsequent events such as the motion or arrest of a captive ball, and on external reactions such as club forces in an effort to reconstruct strike events within the captive ball that cause motion and spin. In doing so, sensor types and their numbers are increased, some components of the strike such as torque cannot be accurately reconstructed, and kinetic energy sinks such as spring compressions and tether extensions must be accommodated; all are error sources, detract from long-term calibration accuracy, and reduce the usefulness of a captive ball practice tee.

BRIEF SUMMARY OF THE INVENTION

Accordingly, the apparatus of this invention focuses on forces and torques within the captive ball that occur during a strike event. The apparatus comprises two separate segments of a simulated golf ball attached to opposing surfaces of a strain plate and a plurality of strain gauges mounted on the strain plate within the ball and on the plate's pivotal support structure. Strains are measured during a strike to the ball to determine a 3D strike force vector, torque components thereof, and strike event duration. Strains caused by centripetal force are also measured after the pivotal structure rotates clear of the striking club and are used to validate strike force measurements and calibration accuracy thereof. The strike force vector and strike duration are used to determine a 3D velocity vector of a free ball similarly struck. Torque content of the strike and strike duration yield both vertical and lateral spin rates. From these data, an accurate 3D trajectory of a free ball similarly struck is computed for display to the golfer.

It is an objective of this invention to:

1. Provide accurate spin rates about both horizontal and vertical axes, as opposed only the vertical axis per the prior art, in addition to a 3D velocity vector so that a trajectory of a free ball similarly struck can be computed with the accuracy needed by the serious golfer.
2. Characterize the actual strike event to minimize potential error sources, rather than attempt to reconstruct it by measuring preliminary events (club face angle, club approach angle, etc) or secondary events (arresting forces, rates of motion, switch activation, etc).
3. Avoid measurement processes that employ kinetic energy sinks (e.g. tethers, springs, friction, etc) that detract from measurement accuracy and long-term calibration accuracy.
4. Provide an apparatus that alerts the user when re-calibration is required.
5. Provide an apparatus that, when struck, produces a familiar impact sensation.
6. Minimize mechanical and electronic part count to make the apparatus affordable.
7. Provide a robust apparatus that is safe and reliable.

How the invention addresses the shortcomings of the prior art and fulfills the requirements for a highly accurate and useful captive ball golf practice tee will become apparent from considering the ensuing description and drawings.

BRIEF DESCRIPTION OF THE SEVERAL VIEWS OF THE DRAWINGS

FIG. 5 is a tabular listing of drawing call-outs used in FIGS. 1–4 and terms used in the specification.

DETAILED DESCRIPTION OF THE INVENTION

Essence of the Invention:

The essence of this invention is direct measurement of a strike force applied to a simulated golf ball in order to calculate an initial velocity vector, initial spin rates about both vertical and horizontal axes, and a trajectory of a free ball similarly struck with greater precision than heretofore possible. Forces of a striking golf club cause a pressure induced planar force within a golf ball that is approximately parallel to the face of the striking club. The planar force may be visualized as an infinite number of identical unit vectors that sum to the club's force vector in both magnitude and direction. The unit vectors act on ball material in their path causing the ball to move in the direction of the force vector in accordance with Newton's second law as it applies to momentum. The strike event lasts about 500 $\mu$s (microseconds) in which the strike force increases from zero magnitude to as much as 14,000 N (Newton) or 3,150 lb (pounds) in 250 $\mu$s and reduces to zero in an equal time. Spin results when the striking club's face is not perpendicular to the strike vector because the planar force unit vectors become unequally disposed about the ball center and thus cause torque. The apparatus described herein characterizes these golf strike phenomena by measuring relative strains produced in a plate inserted in the path of the planar force and by measuring strains produced in the plate's support member.

Figure 1:
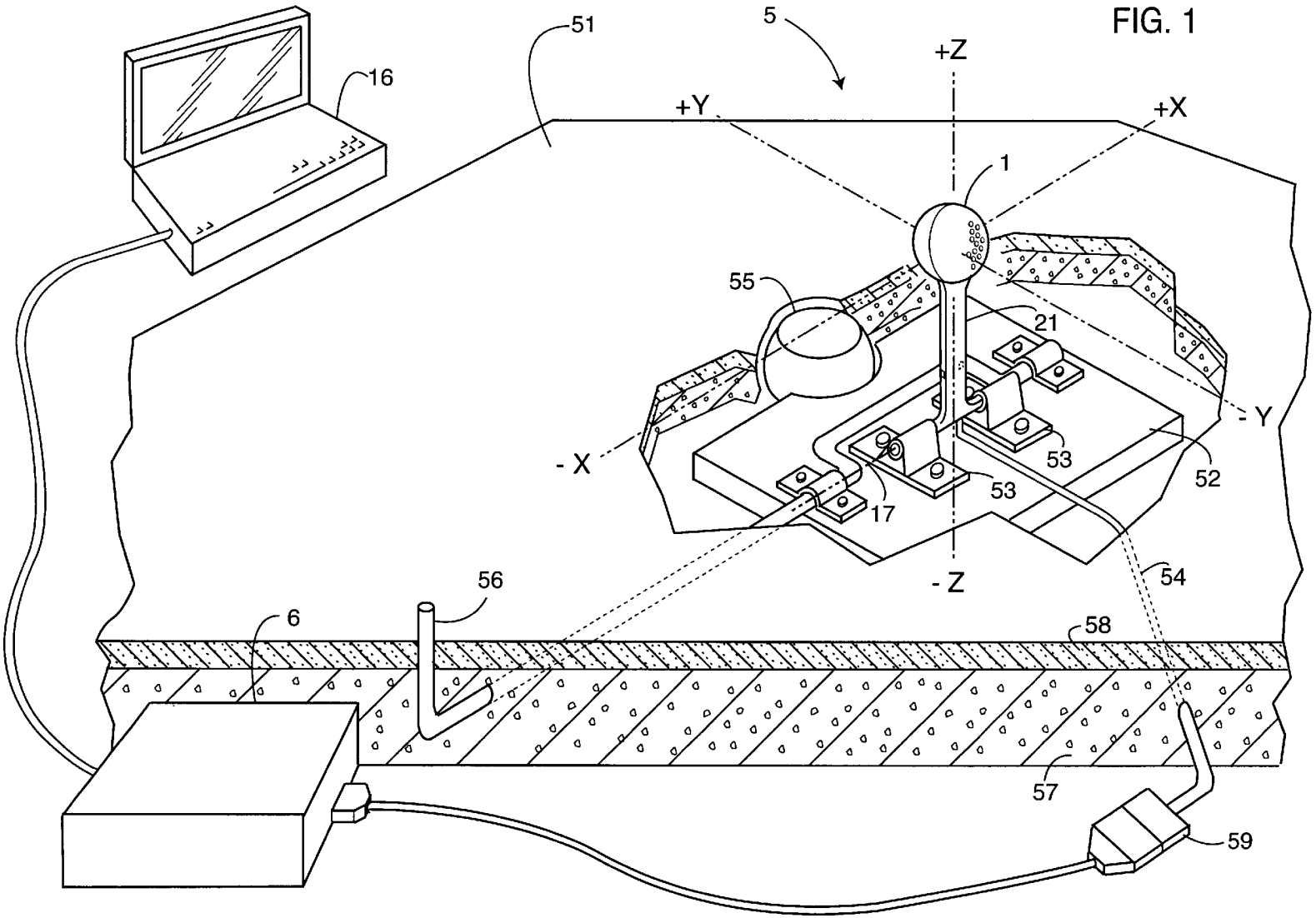
FIG. 1 is a perspective view of captive ball apparatus employed by the present invention and the Cartesian coordinate system used to describe part locations, forces and velocities.

Coordinate System:

The apparatus for strike force characterization and determination of its effect on a free ball similarly struck is generally illustrated in FIG. 1. A Cartesian coordinate system is used to aid discussion of part locations, forces, velocities, spins, and free ball trajectories. The origin of the coordinate system is chosen to be the center of a simulated ball 1 when the apparatus is at a pre-strike, vertical position. The X-axis is parallel to an assembly axis 17 about which the ball 1 rotates when struck. The Y-axis is perpendicular to the X-axis and projects to the horizon. The Z-axis is perpendicular to both the X-axis and Y-axis and vertically bisects a column 21 supporting the ball 1. For simplicity, strike force and initial velocity components directed along the X, Y, or Z-axis are hereafter referred to as X, Y, or Z forces or velocities with "strike", "initial" and "component" being understood.

Figures 2A, 2B, 2C, 2D, 2E:
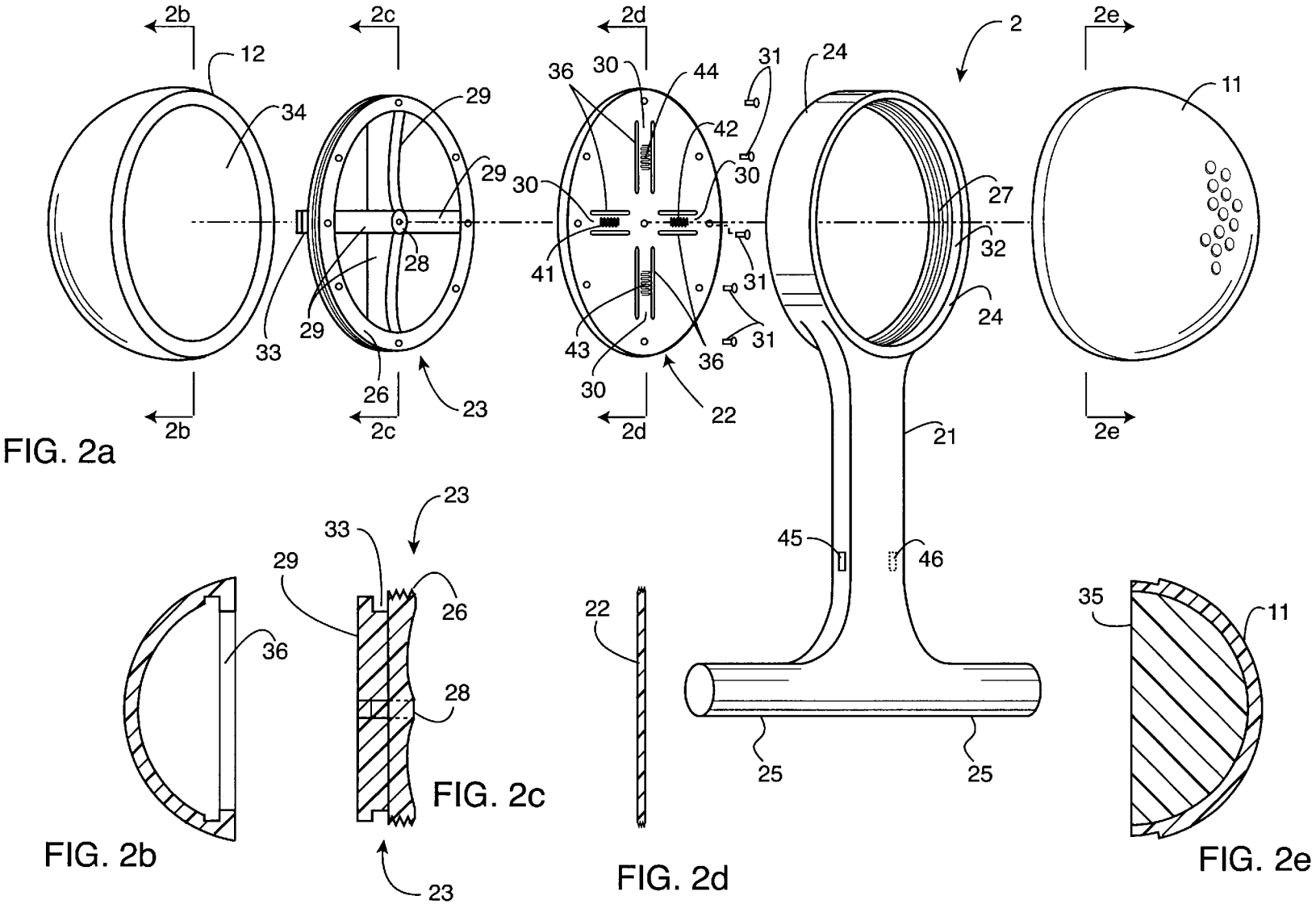
FIG. 2 is an exploded view of a preferred embodiment showing the interrelationship of simulated ball segments, supporting structures, and strain gauges used to measure strike forces.

Key Elements:

Referring to FIG. 2, a ball segment 11 and a shell segment 12 comprise the simulated ball 1 of FIG. 1 and are attached to opposite sides of a support structure 2. The support structure 2 comprises a column 21, a strain plate 22, a wedging plug 23, a retaining collar 24 and axle extensions 25. The key elements of the apparatus are the ball segment 11 that transfers the planar strike force, the strain plate 22 and support column 21 whose strains are proportional to the applied strike force, a set of strategically placed strain gauges 41–46 that output voltage in real time as a function of strain, and the wedging plug 23 that permits measurement of torque producing strains. Additional key elements needed for apparatus operation are an electronics unit 6, shown in FIG. 1, that detects and encodes strain gauge voltages to a digital format, and a software means, installed in a personal computer 16 or the like, also shown in FIG. 1, that converts strain gauge voltages to a set of precision forces, velocities, and spin rates needed to accurately calculate a golf ball trajectory. Other elements of the apparatus, described later, are designed to increase apparatus durability, reduce inertia for a familiar impact sensation, and enhance appearance and/or utility.

The ball segment 11 of FIG. 2 is constructed of material selected from a group of elastomers having a compressibility needed for transferring planar forces and a resiliency needed to assure repeatability. The elastomers that form golf ball cores are typically doped with a high-density material or have a high-density center in order to achieve the maximum mass of 45.93 (1.62 oz.) within the minimum diameter of 42.67 mm (1.68") allowed by the USGA. The covering material is made from elastomers formulated to have sufficient tensile strength to contain core expansion during a strike. A homogeneous, low compression, un-doped, solid core golf ball that may be machined to interface with the plate 22 and collar 24 is a good choice to obtain the desired mechanical properties and reduce the inertia of the apparatus. The means for attaching the ball segment 11 is a contact adhesive, such as a polyurethane mixture, applied to the plate 22, a flat 35 of the ball segment 11, and an unthreaded portion 32 of the retaining collar 24. The ball segment 11 is laterally compressed, inserted into the collar 24 against the plate 22, and allowed to expand against the unthreaded portion of the collar 32 whose slight curvature enhances retention.

The material for the plate 22, column 21, collar 24, and two axle extensions 25 is selected from a group having high tensile strength, low density, and resistance to impact and creep. Machining the column 21, collar 24, and axles 25 from a single piece of beta-type titanium is a good choice to achieve the desired combination of characteristics. Optimum dimensions to minimize inertia while maintaining structural integrity depend on the material, desired height of the ball segment 11 above the axles 25, shape of the column 21, and maximum strike forces anticipated. A generally rectangular column 21 having dimensions of about 65 mm (2.5") in height, for example, tapering from a bottom width of about 32 mm (1¼") to a minimum width of about 20 mm (¾") and tapering from a top and bottom depth of about 13 mm (½") to a minimum depth of about 6 mm (¼") will sustain, with adequate margin, a 30 degree, maximum strike force whose X force component peaks at 7000 N (1575 lb). An axle 25 diameter of about 13 mm (½") is sufficient for a maximum strike provided the distance from the column 21 to support within a journal (53 of FIG. 1) is no more than about 6 mm (¼").

The collar 24, wedging plug 23, and strain plate 22, as an assembled unit, must withstand a Y force peaking at about 14,000 N (3,150 lb) and an X force of 7,000 N (1,575 lb). Without the wedging plug 23, a plate 22 thickness of about 3 mm (⅛"), machined as part of the collar 24, would be required but would have undesirable strain characteristics and would add unacceptable weight to the assembly. Employing the wedging plug 23 stabilizes the center of the plate 22, permitting useable responses from the strain gauges 41–44, and permits weight reductions for both plate 22 and collar 24. The wedging plug 23, constructed as a multi-spoke wheel (further reducing weight), has a threaded rim 26 that mates with a collar threading 27. A hub 28 and the rim 26 of the plug 23 support and stabilize the strain plate 22. A radial thickness for the rim 26 of about 3 mm (⅛") and a depth of about 5 mm (3/16") are good choices, in conjunction strength supplied by the collar 24, to withstand the Y force. Four spokes 29 having a depth of about 9 mm (⅜") and a width of about 3 mm (⅛") are a good choice to stabilize the plate 22. Heat-treated aluminum, such as 7075/T-651, is a good material choice for the wedging plug to provide the required strength while reducing assembly inertia.

A plate 22 thickness is selected whose strain under maximum load (10 N/mm$^2$) will not exceed the limits of the strain gauges 41–44. As supported by the wedging plug 23, a titanium plate 22 thickness, for example, of 1 to 2 mm (1/32"–1/16") has the necessary strength. At that thickness, radial areas 30, having widths of about 3 mm (⅛"), are a reasonable choice for many strain gauge types. The plate 22 is attached to the plug 23 at its center and perimeter using machine screws 31 or the like. After mounting the strain gauges 41–44, the resulting assembly is turned tightly into the threaded portion 27 of the collar 24, the strain gauges 41–44 are aligned with the X and Z axes, and the ball segment 11 is then installed as described earlier.

The radial cross-section of the collar 24 is significantly reduced by employing the wedging plug 23 to increase the overall radial thickness of the combined structure as presented to an X force. Supported by the plug 23, a collar 24 having a Y direction depth of about 13 mm (½"), for example, requires a minimum radial thickness where it joins the column 21 of about 9 mm (⅜"), but can be faired (excluding thread thickness) to about 1 mm (1/32") at 90 degrees and beyond to significantly reduce its inertia. A threading 27 width of about 6 mm (¼") is a good choice to withstand the maximum anticipated Y force. A width of about 6 mm (¼") for the unthreaded portion of the collar 32 is a good choice to restrain ball segment 11 lateral expansion for more efficient Y force transfer to the plate 22, and for transferring the X and Z forces to the column.

The shell segment 12, which absorbs only modest arresting forces, is cast nylon or similar material having a minimum thickness of about 1 mm (1/32"). Slots 33 or the like, cut into the spokes 29, retain the shell 12. A void 34 created by the shell 12, the spoke-wheel construction of the wedging plug 23, and the reduced thickness of the collar permitted by the wedging plug 23 are the primary means for achieving an apparatus inertia approaching that of a free ball and for giving the golfer a familiar impact sensation.

Strain Gauges:

Strain gauges locations are selected in conjunction with the selections of structure dimensions, structure materials and strain gauge type. Strain gauges for measurement of X and Z forces can be located on either the axle extensions 25 or on the column 21. Strains that yield Y force appear at the plate 22 from strike forces and, as discussed later, at the column 21 from centripetal force. Strains that yield Z-axis torque appear at the plate 22 and at the column 21. Strains yielding the X-axis torque appear only at the plate 22. Accordingly, the preferred embodiment strain gauges 41–44 are mounted equidistant from the origin on the X-axis and Z-axis on four radial areas 30 of the plate 22 of FIG. 2 to characterize Y forces, including their X-axis and Z-axis torque content. The radial areas 30 are isolated from strains in other areas of the plate 22 and therefore react only to that portion of the planar strike force impinging directly on them. Isolation of the radial areas 30 is essential for torque measurements and is accomplished by attaching the center and perimeter of the plate 22 to the wedging screw 23 to eliminate transverse strain patterns typical of flat plates and by cutting radial slots 36 to truncate axial strain patterns also typical of flat plates. The X-axis strain gauges 41–42 produce positive voltages, $+E_{-X}$ and $+E_{+X}$ (subscripts denote location) whose difference is a measure of torque about the Z-axis. The Z-axis strain gauges 43–44 produce voltages, $+E_{-Z}$ and $+E_{+Z}$, whose difference is a measure of torque about the X-axis. The voltage sum, $E_{-X}+E_{+X}+E_{-Z}+E_{+Z}$, is a measure of Y force.

The preferred embodiment employs strain gauges 45–46 mounted on the column 21 in the XZ plane and equidistant from the Z-axis to measure X and Z forces. The column mounted strain gauges 45–46 produce equal and same sign voltages, $)E_L$ and $)E_R$, (subscripts denote left, right locations), from the Z force and equal but opposite sign voltages, $)E_L$ and $*E_R$, from the X force. During the strike event, the sum of the column strain gauge 45,46 voltages is a measure of the Z force, and their difference is a measure of the X force. As the ball 11 rotates after the strike event has ended, but prior to arrest, the sum of the column strain gauge 45–46 voltages, $+E_{LC}$ and $+E_{RC}$ is a measure of centripetal force (subscript C denotes centripetal force). Centripetal force is used to correct Z force measurements and to validate measurement accuracy over prolonged use, as explained later. Strain gauges 41–46 are selected whose response characteristics will accommodate strains produced by the maximum and minimum anticipated forces at each mounting surface. For apparatus used in a range of temperatures, gauging both sides of a flexure beam is recommended to cancel gauge errors resulting from changes in gauge resistance.

Figure 3:
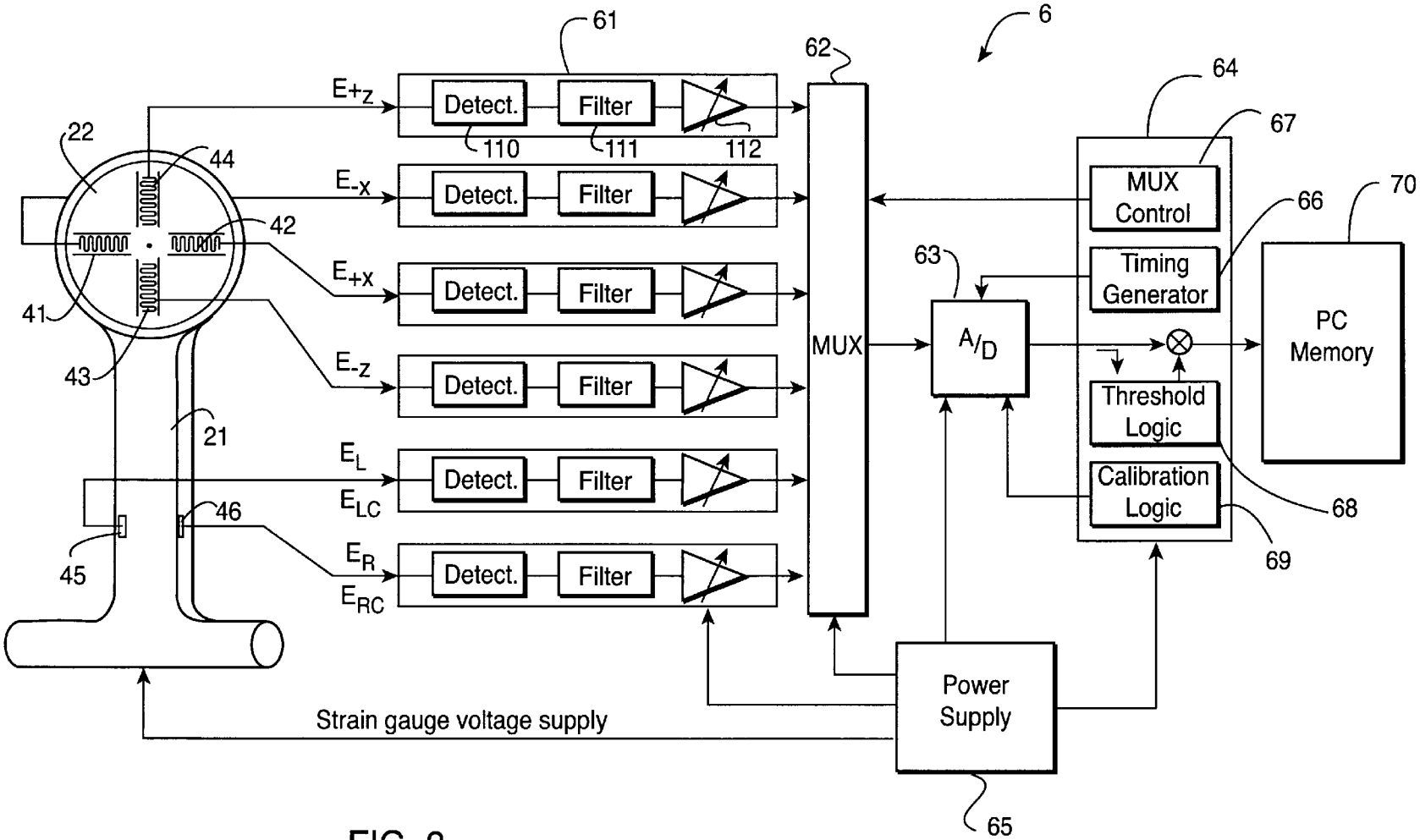
FIG. 3 is a functional diagram depicting strain gauge voltage origins, and a means to encode the strain gauge voltages for digital processing.

Electronics Unit:

The electronics unit 6, depicted as a functional diagram in FIG. 3, is selected from a group of signal conditioning units and designs available on the open market. Included are multi-function units, those with channel-dedicated analog to digital (A/D) devices, and those with a multiplexed A/D serving all channels. Many of the processes performed by the electronics unit 6 and the software, described later, may be performed by analog or digital means, as may be the preference of the designer. With today's technology, the preferred and least costly approach is to immediately convert the analog voltages to digital format using multiplexed A/D electronics as typified by the Cyber-Research INET 100 and controlled by the INET 230. The selected unit 6 has a minimum of six input channels 61, a multiplexer 62, A/D circuit 63, a controller 64, and power conditioning circuits 65. Each input channel 61 is dedicated to sensing 110, filtering 111, and amplifying 112 one of the six strain gauge 41–46 voltages. While Nyquist theory requires only two samples, an A/D 63 dynamic range of at least ten bits and an encoding speed of about 120K samples per second (a minimum of ten samples per channel per event) is recommended to obtain the measurement increment and accuracy needed for precise trajectory calculations. The A/D circuit 63 continuously samples voltages from all channels 61 at programmed intervals. The controller 64 provides timing 66 for the A/D, controls multiplexer 67 switching, voltage thresholding 68, and A/D calibration 69. The thresholding 68 circuits compare every digital sample from a selected channel to a pre-determined value, typically two to three bits higher than noise, and permits data transfer from all channels to assigned segments of PC memory 70 when that value is exceeded. Data transfer is ended when the voltage of the threshold channel falls below the pre-selected value. While any of the plate 22 mounted strain gauge 41–44 voltages may be used to threshold the strike event, the voltage, $E_{-Z}$, from the minus Z-axis strain gauge 43, is recommended because it will tend to be the strongest signal. Following the strike event, as the apparatus rotates to arrest, the controller 64 is programmed to again transfer data from column-mounted strain gauges 45–46, as voltages $E_{LC}$ and $E_{RC}$ (subscript indicates centripetal force). Voltage samples are time tagged by the controller 64 and sent serially to PC memory 70. The controller 64 performs a calibration 69 of each input channel at start-up. A deviation from a normally quiescent zero state causes the controller 64 to adjust the A/D 63 encoding logic to account for the detected offset. The selected controller 64 is similar to the Cyber-Research INET 230 that contains a microprocessor to accommodate the real time functions described, and is constructed as a PCMCIA interface card for laptop computers or as a PCI card for internal PC environments (INET 200). The power conditioning circuits 65 supply regulated voltage to all electronics unit 6 circuits including the strain gauge 41–46 circuits.

Figure 4:
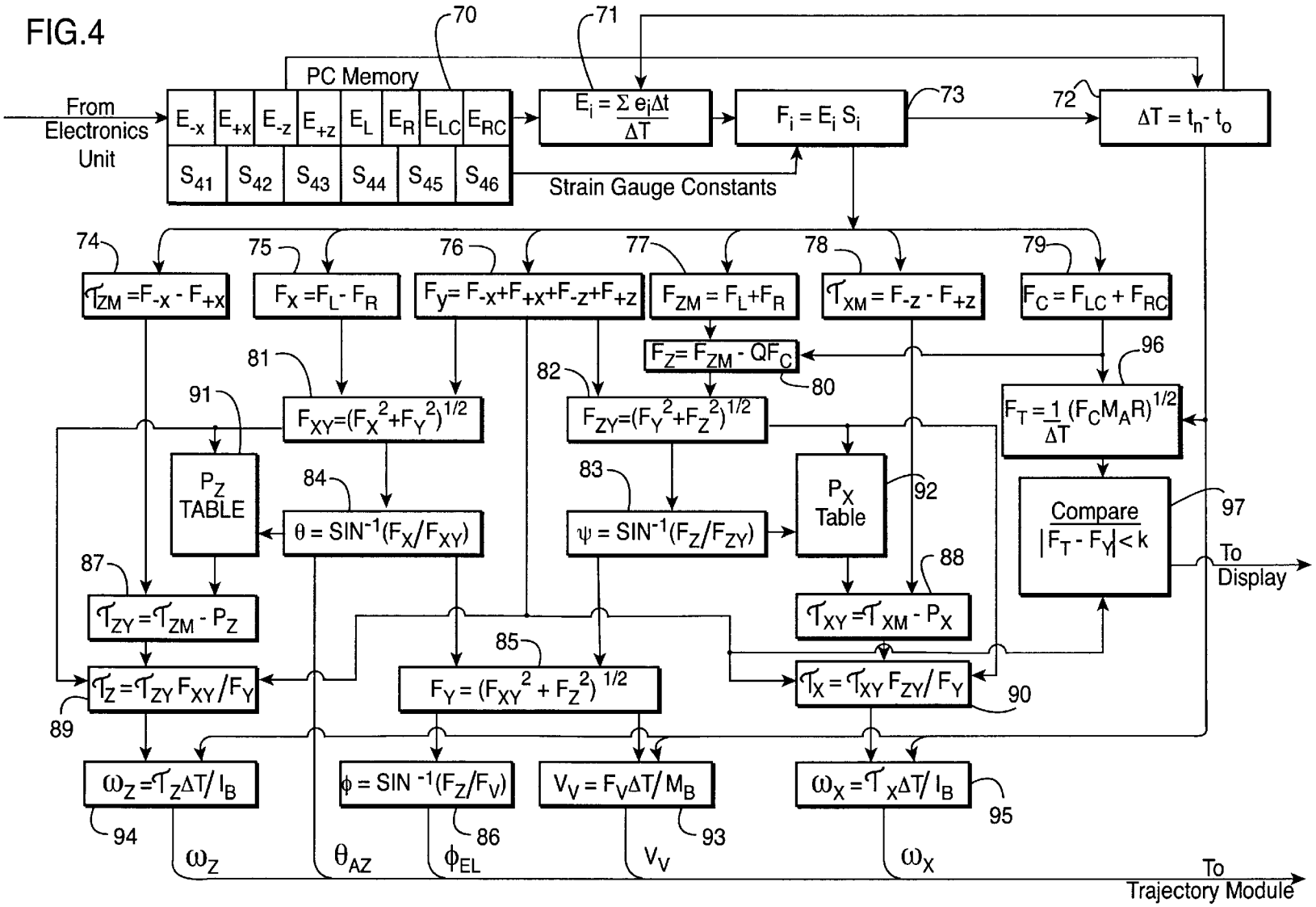
FIG. 4 is a functional diagram of software providing the means to determine a strike force vector, strike time duration, strike force torque content and the initial velocity vector and spin rates required for accurate trajectory calculations.

Software:

The functions of a force/velocity software module shown in FIG. 4 provides the means to convert digitized strain gauge 41–46 voltage samples to forces, torques, angles, velocities, and spin rates as further explained in the operation section. The trajectory software is selected from a group that provides a time ordered trace of free ball flight as a function of initial 3D ball velocity, and spin about the ball's vertical and horizontal axes. One such trajectory computation software candidate that may be viewed at website: telusplanet.net/public/maxs requires only minor modification to accommodate real time input and lateral spin. The PC 16 is one selected from a wide range of consumer PCs and requires only modest speed and memory capabilities.

Utility Items:

Referring to FIG. 1, the mounting base 5 comprises a teeing surface 51, a base plate 52 for mounting axle journals 53, a strain gauge cable assembly 54, an arresting cushion 55, a lever assembly 56, and a small magnetic catch (not shown). The teeing surface 51 height is sufficient to permit the ball 1 to rotate clear from a striking club (not shown). A height of about 6 cm (2.5") is a good choice. The teeing surface 51 is made of rigid plastic foam 57 or the like and a fibrous rubber mat 58 that will provide good traction and the resiliency needed to absorb club strikes. Multiple mats 58 are used to control ball height above the teeing surface 51. For non-portable applications, the height of the surface may be reduced to that of the mat 58 with the journals 53 mounted in a prepared depression. Mats 57 such as those available from FiberBuilt Golf Mat Company are a good choice. The base plate 52 requires sufficient strength and weight to retain the journals 53 and provide the needed stability for accurate force measurements. Steel axle journals 53 with thermoplastic bearings and a large footprint are a good choice for stability. The material for the arresting cushion 55 is selected from a group having moderate resilience such that the energy of the struck ball 1 will be absorbed without rebound, yet return to its original shape in a few seconds. A gel contained by a strong silicone rubber sheathing material is a good choice. The cable assembly 54 houses a minimum of six bundles of four wires each, matching resistors to complete strain gauge voltage bridges (not shown), and a multi-pin connector 59. The lever assembly 56 for returning the apparatus to vertical is a crank or other simple mechanism. The magnetic catch (not shown) comprises two small magnets similar in strength to those used in cabinet hardware and are attached to the column 21 and teeing surface 51.

Apparatus Operation:

Referring to FIG. 1, a golfer stands on the teeing surface 51 and strikes the ball 1 which causes it to rotate clear from the strike into the arresting cushion 55 below the teeing surface 51. He views a 3D trajectory and launch conditions of a free ball similarly struck on the PC 16. The golfer actuates a lever 56 to return the ball 1 to vertical for the next strike with the ball 1 held vertical by a magnetic catch (not shown). The strike force, including the torque content thereof, and centripetal force cause non-zero voltages to appear at the six strain gauges 41–46 of FIG. 3. During the strike event, the support column 21 is deflected left or right by the X force and causes equal but opposite sign voltages, $)E_L$ and $*E_R$, at the column mounted strain gauges 45–46 and whose instant values change as the force increases rapidly form zero to maximum and back to zero in about 500 $\mu$s. The column 21 is simultaneously strained in tension or compression by the Z force and causes equal and same sign voltages, $)E_L$ and $*E_R$. Centripetal force, gradually increasing during the strike, causes a positive delta in each of $E_L$ and $E_R$. During the strike, the Y force and its torque content cause the strain plate 22 to deflect, positive voltages, $+E_{-X}$, $+E_{+X}$, $+E_{-Z}$, and $+E_{+Z}$, to be produced at strain gauges 41–44, and the plate 22 to move about half a ball diameter (10 mm). Voltages at the plate 22 mounted strain gauges 41–44 go to zero after the strike event but the column 21 mounted strain gauges 45–46 voltages reduce to a steady state value reflecting centripetal force until motion is arrested. Voltages from the column 21 mounted strain gauges 45–46 are encoded during the strike as $E_L$ and $E_R$ and as $E_{LC}$ and $E_{RC}$ after the strike. All voltages are detected 110, filtered 111, amplified 112, multiplexed 62, and converted to digital samples 63 by the electronics unit 6 and routed to PC memory 70 as digitized, time tagged voltage samples.

Software Operation:

The means for converting strain gauge voltages to forces, velocities, and spin rates is the software residing in the PC 16. Referring to FIG. 4, voltage samples are extracted from memory after completion of the encoding process. A mean value operation 71 sums magnitude-time increment products of the samples and divides by strike time duration: $E_i=\Sigma e_i\Delta t/\Delta T$. A strike time duration 72 calculation uses time tags to establish the strike duration, $\Delta T$. The voltages are next converted to forces 73 by applying a separate calibration factor, $S_{41}$ for $E_{-X}$, $S_{42}$ for $E_{+X}$, $S_{43}$ for $E_{-Z}$, $S_{44}$ for $E_{+Z}$, $S_{45}$ for $E_L$, and $S_{46}$ for $E_R$ (subscripts indicate strain gauge location), for each of the six strain gauge voltages. Force pairs are added and/or subtracted 74–79 as indicated if FIG. 5 to obtain measured values for X, Y and Z strike forces, $F_X$, $F_Y$, and $F_{MZ}$; torque about the X-axis and Z-axis, $\omega_{MX}$ and $\omega_{MZ}$; and centripetal force, $F_C$. Forces $F_X$, $F_Y$, and $F_C$ require no correction, but $F_{MZ}$ contains a centripetal force component and torque values, $\omega_{MX}$ and $\omega_{MZ}$, require corrections for strikes made at an angle to the Y axis (off-axis strikes) to compensate for the use of a sphere segment to measure spherical phenomena (the subscript M denotes measured).

Force $F_{MZ}$ is corrected 80 to eliminate the centripetal force from the measured value of the Z force: $F_Z=F_{MZ}-QF_C$. By assuming the force impulse curve has a triangular shape (a constant rate of acceleration and deceleration), Q may be computed to be approximately 0.375. However, the value of Q is dependent on the materials selected for the ball segment 11 and on the inertia of the apparatus. Accordingly, calibration tests, described later, are performed to achieve the accuracy required for the Z force. After $F_Z$ is corrected, the force components in the XY and YZ planes and associated angles are computed 81–84: $F_{XY}=(F_X^2+F_Y^2)^{1/2}$; $F_{YZ}=(F_Y^2+F_Z^2)^{1/2}$; $\psi=\sin^{-1}(F_Z/F_{YZ})$; and $\theta=\sin^{-1}(F_X/F_{XY})$. The total strike force vector, consisting of magnitude $F_V$, azimuth angle $\theta$, and elevation angle, $\phi$, is computed 84–86: $\theta=\sin^{-1}(F_X/F_{XY})$; $F_V=(F_{XY}^2+F_Z^2)^{1/2}$; and $\phi=\sin^{-1}(F_Z/F_V)$; Torque values, $\omega_{MX}$ and $\omega_{MZ}$, are corrected 87–88 to remove apparent torque and further adjusted 89–90 in recognition that the torque measurements contain only the torque content of Y-axis directed force. Apparent torque is inherent when using a sphere segment to measure spherical forces. Strikes with no torque content made at non-zero azimuth/elevation angles can produce forces at the base of a sphere segment that are similar to the forces produced by strikes with torque content made at zero azimuth/elevation. Fortunately, the force vector is unaffected by torque content and may therefore be used to correct for apparent torque. Correction values, based on controlled tests made at varying azimuths and magnitudes while holding elevation at zero, are stored in a $P_Z$ table 91. A table of $P_X$ values 92 is similarly established to correct torque about the X-axis. The pointers for accessing the $P_Z$ table 91 are $\theta$ and $F_{XY}$. Accessing the $P_X$ table 92 is done with $\psi$ and $F_{ZY}$. Correction for apparent torque is performed 87–88 by subtraction: $\omega_{ZY}=\omega_{ZM}-P_Z$ and $\omega_{XY}=\omega_{XM}-P_X$ where ZY and XY subscripts indicate torque from the Y-axis directed force, only. Corrections 89–90, to adjust for X-axis or Z-axis directed torque contributions, are performed by ratio: $\omega_Z=\omega_{ZY}(F_{XY}/F_Y)$ and $\omega_X=\omega_{XY}(F_{ZY}/F_Y)$. With the 3D force vector and true torque established, initial velocity magnitude, $V_V$, and spin rates, $\omega_Z$ and $\omega_X$, for a free ball are obtained 93–95: $V_V=F_V\Delta T/M_B$; $\omega_Z=\omega_Z\Delta T/I_B$; and $\omega_X=\omega_X\Delta T/I_B$; where $M_B$ is free ball mass, $I_B$ is free ball moment of inertia, and $\Delta T$ is strike duration. Initial velocity, $V_V$, spin rates, $\omega_Z$ and $\omega_X$, plus initial azimuth and elevation angles, $\theta$ and $\phi$, are sent to the trajectory software module where they are used to compute the trajectory of a free ball similarly struck.

Centripetal force, $F_C$, used to correct the Z force 80, is also used to validate strain gauge 41–46 measurements and indicate faults. The Y force, $F_Y$, and tangential force, $F_T$, are equivalent and may be determined, as is done at 76 $F_Y=F_{-X}+F_{+X}+F_{-Z}+F_{+Z}$ from voltages originating at strain gauges 41–44, or from data originating from strain gauges 45–46 using the relationship 96 between centripetal force and tangential force: $F_Y=F_T=(1/\Delta T)(F_CRM_A)^{1/2}$, where $\Delta T$ is strike duration, R is the radius of rotation of the ball 11 center, and $M_A$ is the effective mass of the apparatus. A difference in the two values suggests an error in one or more strain gauges, the calibration factors, in $\Delta T$ computation, or some combination thereof. The two values are therefore compared 97 to provide a means for validation/fault indication. If the difference 97 of the two values exceeds a predetermined limit, an alert message is displayed on the PC 16 indicating a system malfunction that requires repair and/or recalibration.

Apparatus Calibration:

Calibration tests are performed to obtain voltage-to-force factors $S_{41}$-$S_{46}$ used for converting voltage to force 73 for each of the six strain gauges 41–46 used in the apparatus, to establish the Z force correction 80 value, Q, and to establish tables of values 91–92 used to correct for apparent torque. Prior to calibration testing, strains and associated voltages are calculated to assure strains, strain gauges and voltages are optimum for the selected configuration. Since the strain gauge 41–46 responses are linear and the installation is linear (no non-linear devices or energy drains), the tests will yield six voltage-to-force constants, one for each strain gauge reflecting both gauge factor and installation characteristics ($S_{41}$–$S_{46}$), that are stored in PC memory 70 and applied to all future measurements. The voltage-to-force factors are obtained by applying known X, Y, and Z static forces to the apparatus. After the strain gauge 41–46 voltage-to-force constants have been established, values for apparent torque correction, $P_Z$ and $P_X$, are collected, organized in tabular form, and placed in memory 91–92. The Z-axis torque, $\omega_X$, correction values, $P_Z$ 91, are established by holding elevation angle, $\psi$, at zero, applying a range of static forces, $F_{XY}$, that vary in azimuth, $\theta$, and magnitude, and by tabularizing 91 the apparent torque so obtained. The process is repeated with force magnitude, $F_{ZY}$, and the angle from the YZ plane, $\psi$, being varied while holding azimuth, $\theta$, at zero to establish a table 92 of X-axis apparent torque correction values, $P_X$. The Z force correction 80 value, Q, is established from dynamic tests. An impulse force is applied whose vector coincides with the Y-axis. The Z and centripetal forces, $F_Z$ and $F_C$, are recorded and their ratio yields the value for Q: $Q=F_Z/F_C$. Additional dynamic tests are recommended to verify apparatus accuracy and sensitivity over the range of strike force vectors and torque content anticipated during use.

Alternate Embodiments:

Additional embodiments, including those involving the selection of alternate strain gauge locations, analog versus digital designs, and hardware versus software techniques, are possible, too numerous to detail, and none of which change the basic functionality of the apparatus. Embodiments that reduce performance and eliminate functions, such as elimination of spin determination about the X-axis to reduce strain gauge count for example, are similarly within the scope of the present invention as defined by the claims.

What I claim as my invention is:

1. A captive ball golf practice system comprising:

a strain plate positioned within a simulated ball, said plate adhered to said ball;

a ball retaining collar surrounding said plate and portions of said ball adjacent to said plate, said collar having cross members supporting said plate;

a pivotal column extending from said collar;

a plurality of strain gauges affixed to said plate and said column; and, means for determining a three-dimension velocity vector plus spin rates about two axes of said ball from signals appearing at said strain gauges as a result of a strike to said ball;

whereby a three-dimension trajectory of a free ball similarly struck can be determined based on said velocity vector and said spin rates.

2. The system of claim 1 wherein said collar has interior threads, said cross members are contained in a wedging plug, said plug having external threads that mate with said interior threads of said retaining collar.

3. The system of claim 1 wherein said collar, said column, and said plate are formed as a single homogeneous structure.

4. The system of claim 1 wherein said ball includes a first hemisphere of golf ball material and a second hemisphere comprising a shell and a void.

5. A captive ball golf practice system comprising:

means for positioning a strain plate within a simulated ball;

means for retaining said plate and said ball on a pivotal column, means for supporting said plate against forces produced by a strike to said ball;

means for measuring strains in said plate and said column resulting from said strike; and, means for determining a three-dimension velocity vector plus spin rates about two axes of said ball from said strain measurement means;

whereby a three-dimension trajectory of a free ball similarly struck can be determined based on said velocity vector and said spin rates.

6. The system of claim 5 wherein said retaining means comprise a collar surrounding said plate and adjacent portions of said ball, said collar having internal threads, and wherein said supporting means comprise cross members contained in a wedging plug having external threads that mate with said threads of said collar.

7. The system of claim 5 wherein said plate, said retaining means, said column, and said supporting means are formed as a single homogeneous structure.

8. The system of claim 5 wherein said ball includes a first hemisphere of golf ball material and a second hemisphere comprising a shell and a void.

* * * * *